US010934728B2

(12) United States Patent
Hwang

(10) Patent No.: US 10,934,728 B2
(45) Date of Patent: Mar. 2, 2021

(54) DRAWING CAFE

(71) Applicant: Youngjoon Hwang, Gwangju-si (KR)

(72) Inventor: Youngjoon Hwang, Gwangju-si (KR)

( * ) Notice: Subject to any disclaimer, the term of this patent is extended or adjusted under 35 U.S.C. 154(b) by 0 days.

(21) Appl. No.: 16/463,031

(22) PCT Filed: Nov. 22, 2017

(86) PCT No.: PCT/KR2017/013322
§ 371 (c)(1),
(2) Date: May 22, 2019

(87) PCT Pub. No.: WO2018/097587
PCT Pub. Date: May 31, 2018

(65) Prior Publication Data

US 2020/0199898 A1 Jun. 25, 2020

(30) Foreign Application Priority Data

Nov. 25, 2016 (KR) ..... 10-2016-0158664

(51) Int. Cl.
*E04H 3/10* (2006.01)
*E04H 3/02* (2006.01)
(Continued)

(52) U.S. Cl.
CPC ..... *E04H 3/10* (2013.01); *A47B 96/04* (2013.01); *A63G 31/00* (2013.01); *E04H 3/02* (2013.01)

(58) Field of Classification Search
CPC .. E04H 3/10; E04H 3/02; E04H 14/00; A63G 31/00; A47B 96/04; A63H 33/22
(Continued)

(56) References Cited

U.S. PATENT DOCUMENTS 1,509,407 A * 9/1924 MacQuarrie ..... A47G 1/1686 248/307
2,740,206 A * 4/1956 Schatz ..... G09B 17/00 434/426
(Continued)

FOREIGN PATENT DOCUMENTS

JP 2001162062 6/2001
JP 2006325915 12/2006
(Continued)

OTHER PUBLICATIONS

International Search Reported issued in PCT/KR2017/0133322 dated Apr. 17, 2018.

*Primary Examiner* — Brent W Herring
(74) *Attorney, Agent, or Firm* — Workman Nydegger

(57) ABSTRACT

This invention is about drawing cafe that separate indoor playgrounds and dining room spaces in the cafes, but allows visitors to see indoor playgrounds in the restaurants. The interior wall of the indoor playground is equipped with a drawing wall that can wipe the paint off with water and a blackboard for drawing or scribbling with chalk and parents in the restaurant can observe or monitor their own children playing in the indoor playground. It is the drawing cafe that allows children to move from a static environment of sitting back and painting to a dynamic play where they can mingle independently without parental interference and run around and paint as much as they want. And the composition is composed of indoor playgrounds and restaurants separated by compartment walls, and the above indoor playgrounds are constructed with drawing wall that allows children to draw or play with paint on one inner wall. The compartment wall is constructed for viewing indoor playgrounds from the restaurant by glass windows at the top, the lower side of the compartment wall has other inner walls of the indoor playground (112), and the other inner walls of the indoor
(Continued)

playground have blackboards (114) along the length direction, allowing children to paint or scribble with chalk.

2 Claims, 3 Drawing Sheets

(51) Int. Cl.
*A63G 31/00* (2006.01)
*A47B 96/04* (2006.01)

(58) Field of Classification Search
USPC ..... 52/234, 238.1, 79.1, 136
See application file for complete search history.

(56) References Cited

U.S. PATENT DOCUMENTS 4,274,233 A * 6/1981 Currier ..... E04H 3/02 52/234
5,740,650 A * 4/1998 Seiber ..... A47B 57/425 403/297
5,746,034 A * 5/1998 Luchetti ..... A47B 57/425 52/220.7
5,775,033 A * 7/1998 Meehan ..... E04H 3/04 186/38
5,950,386 A * 9/1999 Shipman ..... A47B 57/425 52/239
6,067,762 A * 5/2000 Greer ..... A47B 57/425 52/220.7
6,128,873 A * 10/2000 Shipman ..... A47B 57/425 52/220.7
6,134,852 A * 10/2000 Shipman ..... A47B 57/425 52/220.7
6,266,935 B1 * 7/2001 Seiber ..... A47B 57/425 52/126.4
6,276,102 B1 * 8/2001 Shipman ..... A47B 57/425 52/220.7
7,019,644 B2 * 3/2006 Barrie ..... G08B 13/19663 340/539.13
8,341,899 B2 * 1/2013 Solomon ..... E04H 3/02 52/234
2004/0150520 A1 * 8/2004 Barrie ..... G08B 13/19663 340/539.13
2007/0289225 A1 * 12/2007 Kern ..... A47B 87/007 52/36.1
2011/0041434 A1 * 2/2011 Solomon ..... E04H 3/02 52/234

FOREIGN PATENT DOCUMENTS

KR 1020130099679 9/2013
KR 101490293 2/2015
KR 2020160003669 10/2016

* cited by examiner

DRAWING CAFE

TECHNICAL FIELD

This invention is about drawing cafe, in more detail, separate indoor playgrounds and dining room spaces in the cafes, but allows visitors to see indoor playgrounds in the restaurants. The interior wall of the indoor playground is equipped with a drawing wall that can wipe the paint off with water and a blackboard for drawing or scribbling with chalk and parents in the restaurant can observe or monitor their own children playing in the indoor playground. It is the drawing cafe that allows children to move from a static environment of sitting back and painting to a dynamic play where they can mingle independently without parental interference and run around and paint as much as they want.

TECHNOLOGIES TO BE BACKGROUND OF THE INVENTION

As it has been noted, we should send our children to playrooms when they are three years old and socialize with their peers. Children develop their social skills and brains through play, so they can develop positive growth by staying with a variety of friends. However, when choosing these daycare centers, it is important to ensure that there are professional nursery teachers with certain qualifications for caring children and the full knowledge of child education. Also, since it is good for a child to develop a diet based on natural food rather than instant food, we need to find out if it has a planned diet that takes care of the child's nutrition. And whether it is safe since it is a place where the child is active for a long time.

Meanwhile, Kids Cafe refers to an indoor playground where mother with young children or parents or caregivers who are temporarily taking care of a child come out of an appointment place and have a meeting between adults, as an example, registration patent No. 1490293 (2015 Feb. 4. Notice.) "Kids Cafe Theme Playroom" was proposed.

As shown in Plan 1 and 2, the kids cafe theme play room has various vegetable, fruit, and fish models displayed on shelves (10*c*), a front wall (11*a*) with entrances (10*a*), and the supermarket play room (10) having the couch connection pathway (10*b*) in which the threshold height reaches 40 cm height from the floor of building (a') on the first floor.

On the second floor, there are handrails (11*a*) for good ventilation and prevention of falls, and transparent windows (11*b*) for the upper part of the handrail (11*a*) for internal and external viewing. On the wall (11") a toy playroom with 1st horizontal transfer passageway (11*c*) is constructed, and the 1st steps (20*a*) and the 2nd steps (20*b*) are constructed along the inside wall (a).

In addition, in Room 1 (30*a*), Room 2 (30*b*), and Room 6 (30*f*), a stairway room (30) equipped with a connecting stairway on an incline is connected to one side of the supermarket playroom (10) and a toy play room (11) consisting of a layer above. The air perpendicular wall (40*b*) with the connecting passageway is connected to the outer wall of room 6 (30*f*) and the connecting path is connected in a manner consistent with the position of the 2nd horizontal transfer passageway (36). When the air mattress (40*a*) is inflated, its surface height coincides with the floor level of Room 6 (30*f*) and the air bounce room (40*c*) with the cushion panel (40*c*) on the incline shall be constructed in a row outside the stairway (30) above.

And the impact absorption pad (b) is attached to the inner wall (a) and the building floor (a'), and a rectangular frame

(51) is installed to fill the rubber balls (60). A ball-pool (50) with a fence (51*a*) and a door (52) will be connected to the air bounce room (40) above in a row. The interior wall (70*a*) is equipped with an impact absorption pad (b), and Mother and Child Room (70) with a sofa (73) for infant breastfeeding and sleep is constructed in the front side of the ball-pool (50). On the front outside of the Mother and Child Room (70), a sink (72) of the child's height is installed, a sofa (12) is installed fixed along the interior wall (a), and a reading room (80) consisting of interior wall (80*a*) and a sofa connecting passageway (80*b*) and an entrance (80') with a height parallel to that of the above sofa (12) is made. It is equipped with a kitchen (90) where one can cook tea, beverages and ordered food, and a rest area (100) with tables (101) and chairs (102).

However, these traditional playrooms or kids cafes were not separated completely from their parents, so that children lacked social skills by playing independently in their own spaces, and that play was not enough to satisfy the children's desire to paint pictures which can't express by writing because they were moving in an already installed device, which led to the lack of social creativity and brain development.

PREVIOUS WRITTEN DOCUMENT

Patent Document (Patent document 0001) Registration Patent No. 1490293 (2015 Feb. 4. Notice.) "Kids cafe theme Playroom"

DETAILS OF INVENTION

Task to Solve

So this invention was created to solve the existing problems such as above. This purpose of it is to separate indoor playgrounds and dining room spaces in the cafes, but allows visitors to see indoor playgrounds in the restaurants. The interior wall of the indoor playground is equipped with a drawing wall that can wipe the paint off with water and a blackboard for drawing or scribbling with chalk and parents in the restaurant can observe or monitor their own children playing in the indoor playground. It is the drawing cafe that allows children to move from a static environment of sitting back and painting to a dynamic play where they can mingle independently without parental interference and run around and paint as much as they want.

Task Solutions

In order to achieve the purpose of this invention, the Drawing cafe in this invention is composed of indoor playgrounds and restaurants separated by compartment walls, and the above indoor playgrounds are constructed with drawing wall that allows children to draw or play with paint on one inner wall. The compartment wall is constructed for viewing indoor playgrounds from the restaurant by glass windows at the top, the lower side of the compartment wall has other inner walls of the indoor playground, and the other inner walls of the indoor playground have blackboards (114) along the length direction, allowing children to paint or scribble with chalk.

In addition, the above indoor playground includes additional water sprayer on the front top of the water slide surface, and a drain is formed along the length direction of the inner wall of the one side and the top of the drain is equipped with trenches. The first slope plane is formed between one inner wall and the drain, the second slope is formed between the other inner wall of the top indoor playground and the bottom surface is consist of concavo-convex along the length direction of the indoor playground.

Effects of Invention

As mentioned above, this invention separates the space between the indoor playground and the restaurant through the compartment wall, makes the top of the compartment wall a glass window for viewing the indoor playground at the restaurant, and allows children to paint with paint or play with water on one inner wall, and paints on the lower side of the section glass wall. So parents at the restaurant can watch or monitor their child playing in the indoor playground—it allows children to move from a static environment of sitting back and painting to a dynamic play where they can mingle independently without parental interference and run around and paint as much as they want. It helps children grow bright and strong, and has the effect of increasing creativity as well as social and brain development.

DETAILED CONTENTS TO CARRY OUT THE INVENTION

Below, the composition of this invention shall be described in detail according to the model of implementation, with the attached drawings as a reference.

Figure 3:
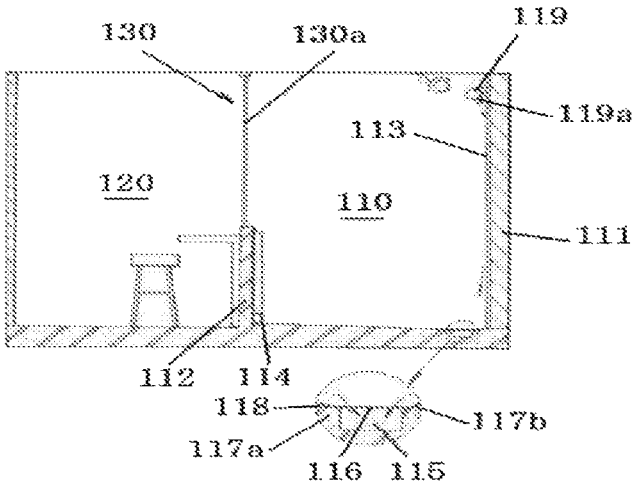
FIG. 3 shows the layout of the Drawing Cafe by this invention.

FIG. 3 shows the layout of drawing cafes by this invention, as shown here, the invention shows that the indoor playground (110) and the restaurant (120) are separated by the compartment wall (130) and the indoor playground (110) has a larger area than the kitchen (140) or hall (150) and the restaurant (120). In addition, in the indoor playground (110), a trench, or drain cover, is formed in the forward direction along the length of one inner wall (111) of the indoor playground (111). It is natural that the above drain covers are constructed so that water can flow into the drain (not marked) side of the lower side.

Thus, the formation of trenches (116) and drains in the indoor playground (111) allows children to paint with paint and then erase with water on one inner wall (111) of the indoor playground (110), so that one inner wall (111) of the indoor playground (110) can be painted white-based or attached to the seat to allow children to paint. In addition, water spray devices with a water duster or with nozzles (not shown) along one inner wall (111) of the indoor playground (110) upper length direction can be installed to allow water to be sprayed from the nozzle of the water dispensing device when necessary to remove the paint. For this purpose, the chamber of the water tank (160) is constructed in an adjacent space of the indoor playground (110). In addition, under the other inner wall (112) of the indoor playground (110) a blackboard is constructed along the length so that children can paint or scribble freely with chalk.

And the compartment wall (130) separating the space between the indoor playground (110) and the restaurant (120) is made of glass material. As a result, parents at the restaurant (120) will be able to observe or monitor their child playing in the indoor playground (110)—whether the child is drawing pictures, getting along well with other children, and whether there are any behavioral problems or discomforts at the restaurant (120).

In general, separate space is the process of building space with different functions or purposes independently to form the whole. By separating space independently from the indoor playground (110) where children can paint or scribble on the blackboard with paint or chalk, children who used to sit still and paint in a static environment now play dynamic games of scribbling and painting on walls without parental interference, which not only helps them grow brighter and stronger, but also improves their social skills and brain development.

Usually, graffiti paintings by children aged 2 to 4 are also said to be a good way to express their feelings. Children of this period are said to express themselves in pictures that draw lines at will because they are actively developed. Since doodling is an activity that can free oneself, even children who are emotionally depressed can enjoy it to their heart's content. When a child is over four years old, one will start painting something, which will allow people to understand what one painted without having to explain, and at this time, people will be able to understand the child's psychology. Children over the age of five are advanced enough to draw pictures that fit a given topic. However, since the development of small muscles is still immature, dealing with materials such as pencils is poor and it is difficult to draw a complete form of painting. This period can be thought of as expressing the writing in a painting, and the painting comes out as a painting when they look at something closely, so they can increase their insight into things. Children over the age of six know how to make proper use of various materials, and they are also enriched with what they want to express. So they become more motivated to actively paint what they want to draw.

Figure 4:
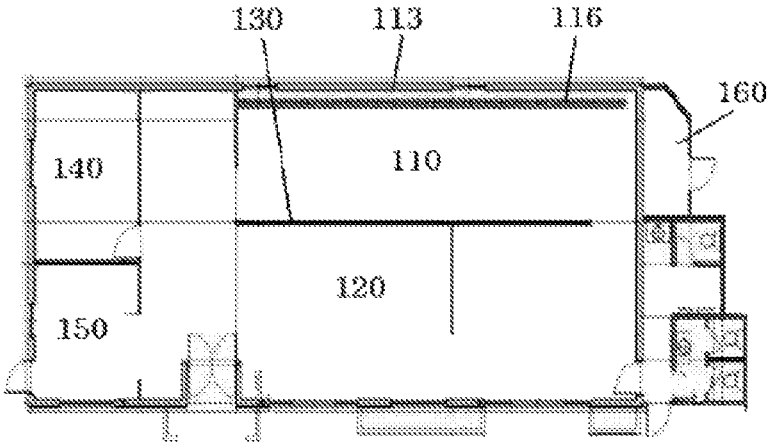
FIG. 4 is the cross-sectional diagram of main part of FIG. 3.

FIG. 4 is a cross-sectional diagram that shows the main part of FIG. 3. This invention separates the space of the indoor playground (110) and the restaurant (120) by the compartment wall (130). An indoor playground (110) is a place where a drawing wall (113) forms on one inner wall (111) so that children can paint or play with paint on it (113). A drawing wall (113) may be constructed by painting white pate that can be erased by water on one inner wall (111) of the indoor playground (110) or attaching a sheet. The compartment wall (130) is constructed with glass windows (130*a*) at the top so that visitors can see the indoor playground (110) at the restaurant (120), and includes the other inner wall of the indoor playground (110) at the bottom. The other inner wall (112) is constructed with a blackboard (114) along the length direction so that children can paint or scribble on the blackboard (114) with chalk.

In addition, the indoor playground (110) has a drain (115) along the length direction of one inner wall (111) on the front side of the drawing wall (113), and the top of the drain (115) is equipped with a trench (116) with a drain cover with a drain hole. In addition, a first slope (117*a*) is formed between one inner wall (111) and the drain (115) so that water falling on the floor between one inner wall (111) and the drain (115) can be induced into the drain (117*a*) on the first slope (117*a*). Form a second inclined plane (117*b*) between the other inner wall (112) and the drain (115), where the blackboard (114) is fitted, so that water or water falling on the floor between the other inner wall (112) and the drain (115*b*) can be directed to the drain (115*b*). Also, to prevent children from sliding and getting hurt by water from the floor, a convex surface (118) is formed along the length direction of the indoor playground (1110) on the floor ( ). It is desirable to have a cushioned rug on the hard floor to prevent children from getting hurt in the event of a fall, so that water is drained to the floor of the indoor playground (110) and there is no moisture left.

Figure 1:
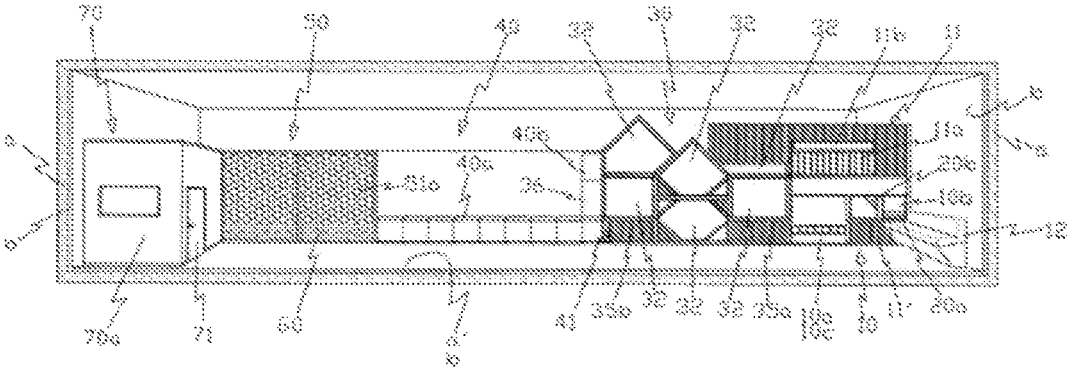
FIG. 1 is the front view of the traditional Kids cafe theme play room.
Figure 2:
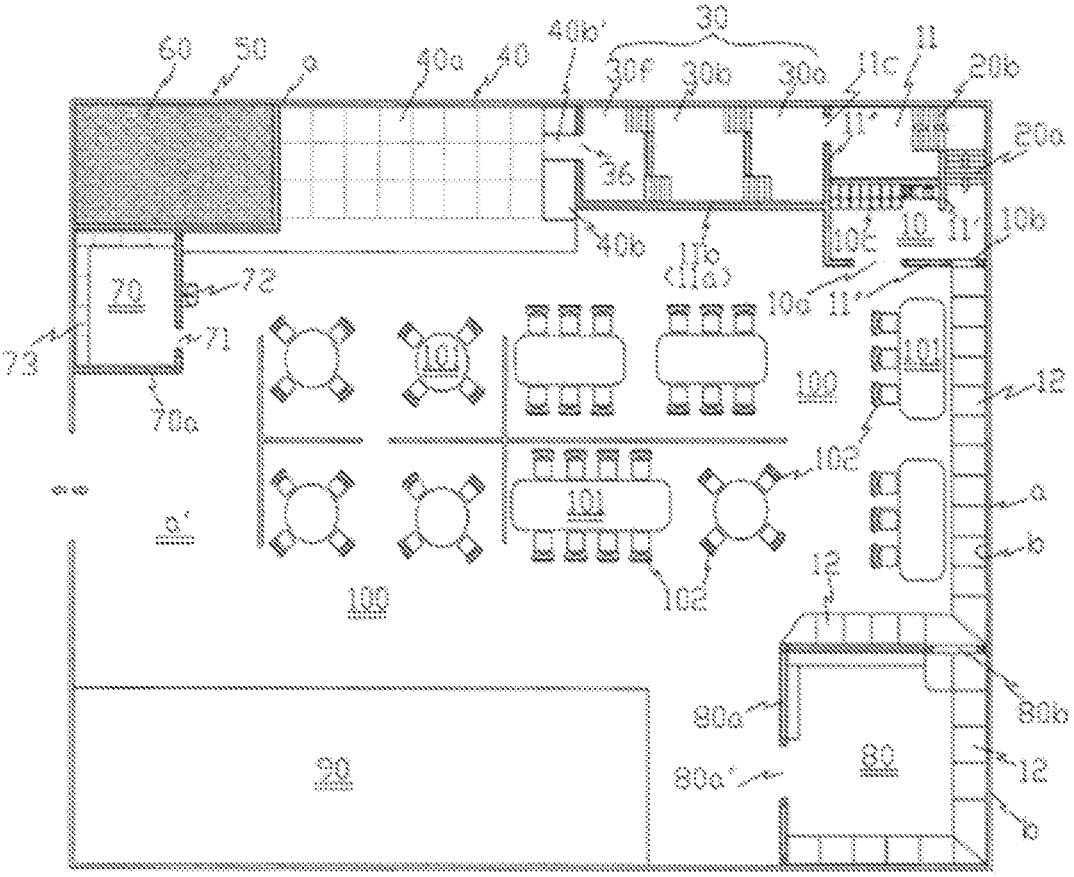
FIG. 2 is a plan of layout of the traditional Kids cafe theme play room.

And the indoor playground (110) includes additional water sprayer (119) on the front top of the drawing wall (113). The water sprayer (119) is equipped with a number of nozzles (119) heading to the drawing wall (113), which is in the form of a horizontal tube with a corresponding length to the drawing wall (113). Water is supplied from the water tank chamber (160) in FIG. 1, and the switch operation results in the supply and shutdown of water to the water supply tube ( ). Usually, children are allowed to play for 45 minutes and take a break for 15 minutes. When they take a break, water is sprayed into the drawing wall (113) to clean up, and the paintwork is removed from the blackboard (114) to create a new environment for children to play.

Thus, this invention separates the space between the indoor playground and the restaurant through the compartment wall, makes the top of the compartment wall a glass window for viewing the indoor playground at the restaurant, and allows children to paint with paint or play with water on one inner wall, and paints on the lower side of the section glass wall. So parents at the restaurant can watch or monitor their child playing in the indoor playground—it allows children to move from a static environment of sitting back and painting to a dynamic play where they can mingle independently without parental interference and run around and paint as much as they want. It helps children grow bright and strong, and has the effect of increasing creativity as well as social and brain development.

The drawing cafe by this invention is specifically described, but this invention is not limited to the most desirable form of implementation of this invention, and its scope is determined and limited by the scope of the patent claim attached. In addition, any person with ordinary knowledge in this field of technology will be able to perform a variety of the invention and embodiments according to the specifications of this invention, but it is clear that it also is not outside the scope of this invention.

SPECIFICATION OF SYMBOLS

| | |
|---|---|
| 110: Indoor Playground | 111, 112: One-sided and Inner Walls |
| 113: Drawing wall | 114: Blackboard |
| 116: Trench | 117a, 117b: Slope 1, 2 |
| 118: concavoconvex | 119: Water sprayer |
| 119a: Nozzle | |
| 120: Restaurant | 130: Window |
| 140: Kitchen | 150: Hall |
| 160: Water Tank chamber | |

The invention claimed is:

1. A drawing cafe comprising an indoor playground and a restaurant separated by a compartment wall, the indoor playground (comprising a drawing wall from which paint can be wiped off on one side of an inner wall so that children can draw or play with paint, the compartment wall having a glass window on a top thereof so that people can see the indoor playground from the restaurant, a lower side of the compartment comprising another inner wall of the indoor playground, wherein the other inner wall of the indoor playground is a blackboard along its length that permits children to draw or scribble with chalk, the indoor playground further comprising a water sprayer on the drawing wall and a drain adjacent to the inner wall.

2. The drawing cafe of claim 1, wherein the water sprayer is on a front top of the drawing wall and the drain is along a lengthwise direction of the inner wall, wherein the inner wall is one-sided and is formed on a front side of the drawing wall, wherein a top of the drain is equipped with a trench having a first slope formed between the one-sided inner wall and the drain with the drawing wall and a second slope formed between another inner wall of the indoor playground and the drain, and wherein a concavoconvex surface is formed along a lengthwise direction of the indoor playground on the floor surface of the indoor playground.

* * * * *